US005208107A

United States Patent [19]

Yeh et al.

[11] Patent Number: 5,208,107

[45] Date of Patent: May 4, 1993

[54] HOLLOW TRILOBAL CROSS-SECTION FILAMENT

[75] Inventors: Ling Yeh, Asheville; Richard Kotek, Arden, both of N.C.

[73] Assignee: BASF Corporation, Parsippany, N.J.

[21] Appl. No.: 708,156

[22] Filed: May 31, 1991

[51] Int. Cl.[5] ..... B29C 47/12; B32B 3/02; D02G 3/00

[52] U.S. Cl. ..... 428/397; 428/92; 428/398; 264/177.13; 264/177.14

[58] Field of Search ..... 428/92, 97, 397, 398, 428/357; 264/177.13, 177.14

[56] References Cited

U.S. PATENT DOCUMENTS

| | | | |
|---|---|---|---|
| 2,939,201 | 6/1960 | Holland | 28/82 |
| 3,095,258 | 6/1963 | Scott | 18/54 |
| 3,194,002 | 7/1965 | Raynolds et al. | 57/140 |
| 3,253,301 | 5/1966 | McGlaughlin | 18/8 |
| 3,303,530 | 2/1967 | Cobb, Jr. | 18/8 |
| 3,357,048 | 12/1967 | Cobb, Jr. | 18/8 |
| 3,493,459 | 2/1970 | McIntosh et al. | 161/178 |
| 3,528,128 | 9/1970 | Murakami et al. | 18/8 |
| 3,558,420 | 1/1971 | Opfell | 161/176 |
| 3,650,659 | 3/1972 | Stapp | 425/461 |
| 3,745,061 | 7/1973 | Champaneria et al. | 161/178 |
| 3,981,948 | 9/1976 | Phillips | 428/397 |
| 4,279,053 | 7/1981 | Payne et al. | 428/398 |
| 4,357,290 | 11/1982 | Yu | 428/374 |
| 4,364,996 | 12/1982 | Sugiyama | 428/398 |
| 4,407,889 | 10/1983 | Gintis et al. | 428/398 |
| 4,492,731 | 1/1985 | Bankar et al. | 428/362 |
| 4,648,830 | 3/1987 | Peterson et al. | 428/397 |
| 4,770,938 | 9/1988 | Peterson et al. | 428/398 |
| 4,956,237 | 9/1990 | Samuelson | 428/398 |

OTHER PUBLICATIONS

"Chart of Irregular Holes", Kasen Nozzle Mfg. Co., Ltd., Nov. 20, 1977.

*Primary Examiner*—George F. Lesmes
*Assistant Examiner*—Kathryne E. Shelbourne

[57] ABSTRACT

A multilobal synthetic polymeric filament has a single approximately axially extending central void. The total cross-sectional void area of the filament is between about 3 and about 10 percent void.

4 Claims, 2 Drawing Sheets

DIMENSIONS ARE IN MILLIMETERS

HOLLOW TRILOBAL CROSS-SECTION FILAMENT

FIELD OF THE INVENTION

This invention relates generally to synthetic polymeric fibrous materials. More specifically, this invention relates to hollow trilobal cross-section filaments.

BACKGROUND OF THE INVENTION

For many uses of fibrous synthetic polymers, it is desirable to minimize the weight of fiber needed to spread over an area. This qualitative property of a fiber is known as "cover". Another quality of fibers for certain end uses (like for carpet yarn) is the fiber's ability to hide soil. Yet, while for some end uses it is important to obtain high cover and good soil hiding, sparkle and/or luster should not be sacrificed. For example, carpet yarns should provide the greatest cover and hide soil well, yet remain lustrous. Efforts to achieve a fabric having these characteristics have largely failed since fiber properties leading to soil hiding tend to lessen luster. Presently, Applicants are unaware of any fiber which effectively achieves all these qualities.

Trilobal fibers are known to provide cover superior to round cross-sections and it is known to make trilobal and pseudo-trilobal filaments (e.g., deltas, T-shapes). Exemplary are U.S. Pat. No. 3,981,948 to Phillips, U.S. Pat. No. 3,194,002 to Raynolds et at., U.S. Pat. No. 2,939,201 to Holland, U.S. Pat. No. 4,492,731 to Bankar et al. and Japanese Kokai 42-22574.

It is also known to provide voids in filaments and that many times these voids result in improved soiling hiding performance. U.S. Pat. No. 3,745,061 to Champaneria et al. and U.S. Pat. No. 4,407,889 to Gintis et al. show non-round filaments having one or more voids.

It is known also to provide trilobal or pseudo-trilobal fibers which have one or more voids. Exemplary are U.S. Pat. No. 3,095,258 to Scott, U.S. Pat. No. 3,357,048 to Cobb, Jr., U.S. Pat. No. 3,493,459 to McIntosh et al., U.S. Pat. No. 3,558,420 to Opfell, U.S. Pat. No. 4,279,053 to Payne et al., U.S. Pat. No. 4,364,996 to Sugiyama, U.S. Pat. No. 4,956,237 to Samuelsom and British Patent No. 843,179 to Siemer et al.

U.S. Pat. No. 4,648,830 to Peterson et al. discloses a spinneret for manufacturing hollow trilobal cross-section filaments. The filaments disclosed therein have one axially extending hole in each lobe.

SUMMARY OF THE INVENTION

To address the foregoing deficiencies, the present invention concerns a multilobal synthetic polymeric filament having a single approximately axially extending central void. The total cross-section void area of the filament is between about 3 and about 10 percent void.

It is an object of the present invention to provide an improved hollow trilobal filament.

Related objects and advantages will be apparent to the ordinarily skilled artisan after reading the following detailed description of the invention.

DETAILED DESCRIPTION OF THE PREFERRED EMBODIMENTS

Figure 1:
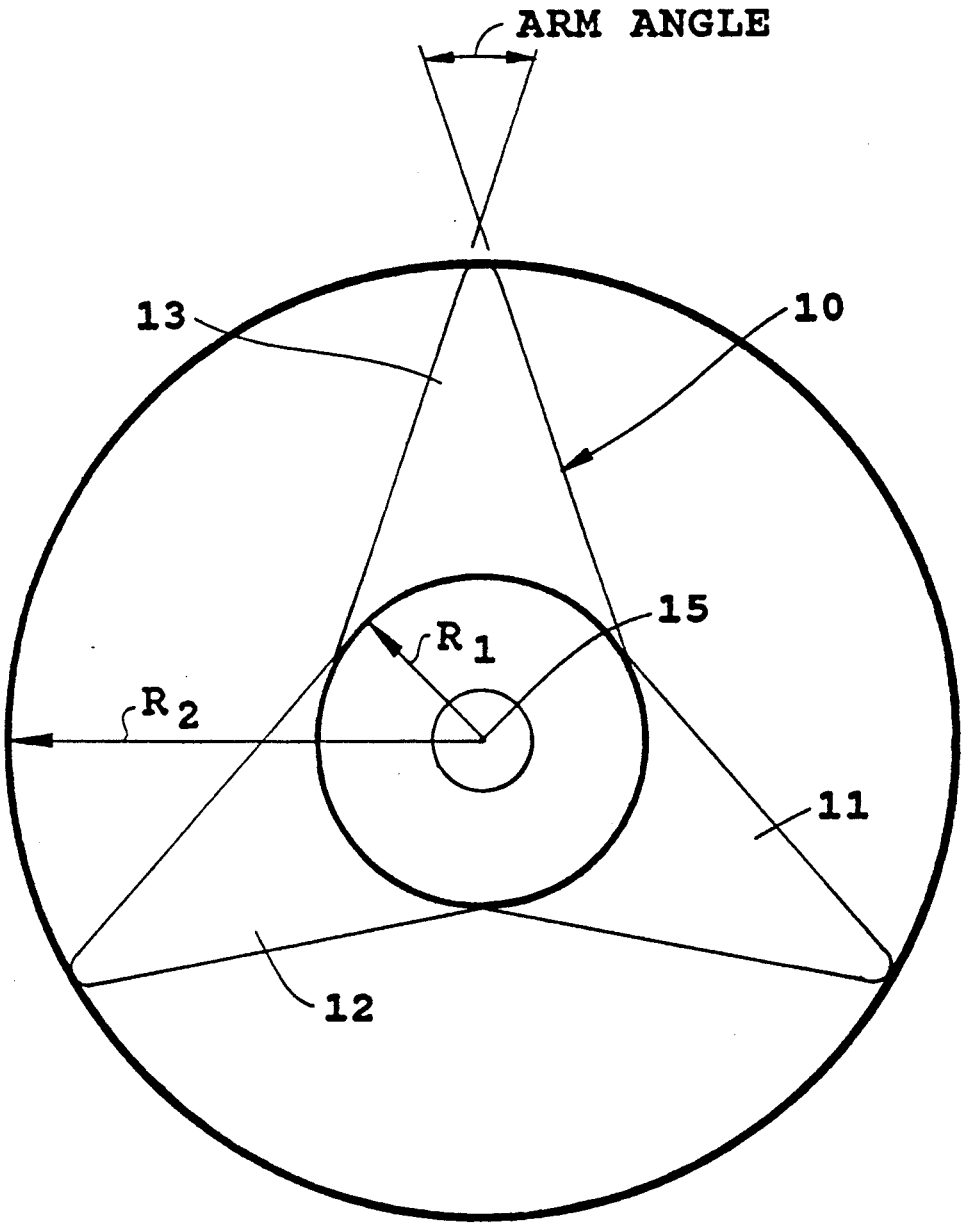
FIG. 1 is a cross-sectional plan view of a filament according to the present invention.

The term "modification ratio" (MR) means the ratio of the radius $R_2$ of the circumscribed circle to the radius $R_1$ of the inscribed circle as shown in FIG. 1. The term "arm angle" (AA) is the angle formed by extension of sides of an arm as shown in FIG. 2.

Depicted in FIG. 1 is an enlarged view of fiber 10 which is representative of the present invention. Filament 10 is trilobal having three (3) lobes, 11, 12 and 13 and axially extending, more or less central, void 15.

According to the present invention, filament 10 preferably has a modification ratio of between about 2 to about 6, more preferably about 2.0 to about 3.5 and an arm angle between about 7° and about 35°. The single approximately central void represents about 3 to about 10 percent, preferably 5 to 8 percent, of the total fiber volume measured including the volume of the void.

Figure 2:
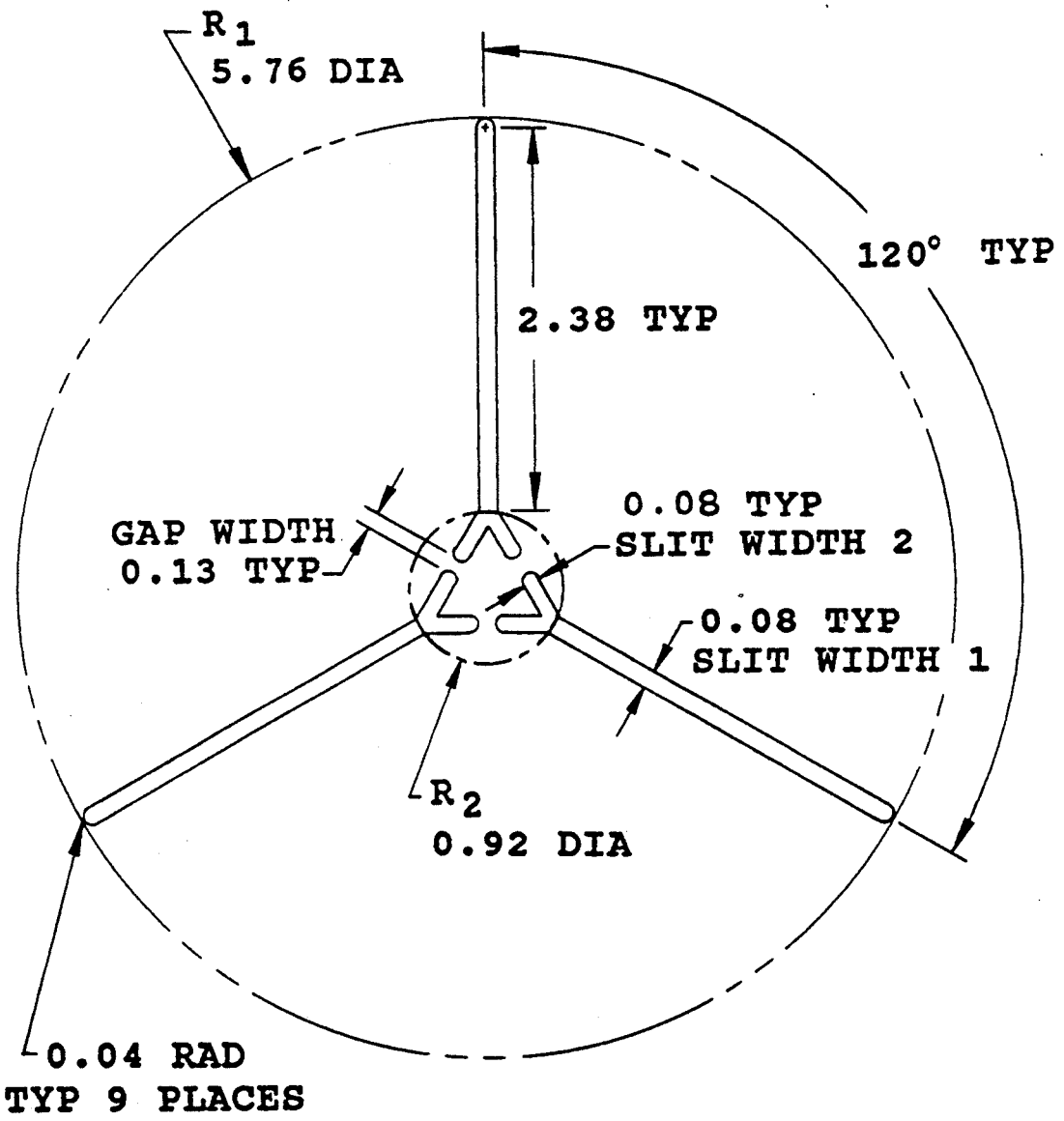
FIG. 2 is a plan view of a spinneret useful to prepare the filament of FIG. 1.

FIG. 2 illustrates a spinneret useful for preparing the filament of the present invention. This spinneret is exemplary of one which is described in copending U.S. patent application Ser. No. 07/708,423 filed May 31, 1991, now abandoned.

Filaments of the present invention may be prepared from synthetic thermoplastic polymers which are melt spinnable. Exemplary polymers are polyamides such as poly(hexamethylene adipamide), polycaprolactam and polyamides of bis(4-aminocyclohexyl)methane and linear aliphatic dicarboxylic acids containing 9, 10 and 12 carbon atoms; copolyamides; polyester such as poly (ethylene) terephthalic acid and copolymers thereof; and polyolefins such as polyethylene and polypropylene. Both heterogeneous and homogeneous mixtures of such polymers may also be used.

As is apparent to one ordinarily skilled in the art, the filaments can be prepared by known methods of spinning filaments. Molten polymer is spun through spinneret orifices shaped to provide the desired void volume and filament cross-sections under spinning conditions which give the desired denier. Specific spinning conditions and spinneret orifices, shapes and dimensions will vary depending upon the particular polymer and filament product being spun.

To achieve the desired percent void, the spinning and quenching conditions are modified appropriately. For example, the percent void can generally be increased by more rapid quenching of the molten filaments by increasing the polymer melt viscosity.

TEST METHODS

Percent Void:

The filament ends of a length of yarn weighing from 6 to 8 grams are sealed by melting with a flame. The yarn is weighed. Using a conventional pycnometer the yarn density is determined. The density of a solid filament yarn is also determined with the same method as a control. Percent void is then calculated by subtracting the density of the hollow filament yarn from the density of the solid control, dividing the result by the density of the solid filament yarn and then multiplying by 100.

Soiling:

3 ft.×6 ft mock-dyed carpet samples, made from fibers with various cross-sections (of interest), are installed in a heavily traveled corridor for 50,000 passes. The samples are then cleaned with a standard vacuum cleaner and visually ranked for degree of soiling. Lower numbers represent less degree of soiling.

Arm Angle:

Fiber cross sections are magnified (300×) to determine the arm angle. Two tangent straight lines are drawn for each arm and the angle formed from the two straight lines is measured. The reported arm angle represents the average of ten measurements.

Luster:

For carpet:

Cut pile carpets are made by standard tufting methods from cabled and heatset yarns. After mock dyeing, the carpets are visually ranked for luster. Lower numbers represent higher degree of luster.

For yarn:

A recording goniophotometer (HunterLab Goniophotometer GP-1R Serial 1050) is used to obtain reflectance readings. at varying angles. A fixed angle of incidence (60°) and varied angle of detection (−120° to 30°) is used. Yarn samples are wound in parallel on a 1.5"×4" card. There are about four to five layers of yarn on each card. The measurement conditions are:

VS1-3

VS2-2 neutral density filter #25 incident angle −60° scanned from −120° to −30°

The actual specular peak for each sample is obtained from the recording chart.

The angle is about 60°. Luster is calculated by the following equation:

$$L=(1-D/S)\times 100$$

Where D is percent reflectance reading of diffused light and S is percent reflectance reading of specular peak.

Cover:

Two types of samples, one heatset and one not, are bulked in hot water (210° F.) for thirty minutes, dried and conditioned (68° F., 65% RH) overnight. A length of each yarn weighing about four grams is collected and its exact weight determined. Individual specimens are fluffed by hand and placed in a Teflon cylinder (4×20 cm) loosely. An Instron instrument is used to measure the space a sample occupies at 9/10 full scale load (9,000 g). Specific volume of the sample is calculated and expressed in cc/g. This procedure is repeated three times for each sample. The average of the three measurements is reported.

Carpet Wear:

Swivel chair test:

A carpet sample is cut to 53 inches×48 inches. The carpet sample is taped to a platform with carpet tape. A metal chair with casters is filled with 100 lbs weight and put onto the carpet. The chair is hooked to a motorized plunger rod and rotates on the carpet while the plunger rod cycles back and forth. The orientation of the carpet sample is periodically changed. At the end of 1,500 cycles, the degree of wear is assessed by a paired comparison.

Paired comparison:

A paired comparison test is conducted using eleven observers. The objective of the examination is to compare two carpets at a time and to select a carpet sample that has better overall appearance after a fixed amount of wear. The data received from the observers is processed by using a preference table. The observer's entry is treated in the following way:

S represents the score $A_i$ represents carpet sample i in a series $A_j$ represents carpet sample j in a series t represents the total number of samples in the paired comparison evaluation If $A_i > A_j$ then $S_{ij}=1$ If $A_i = A_j$ then $S_{ij}=0.5$ If $A_i < A_j$ then $S_{ij}=0$ If $S_{ij}=1$ then $S_{ji}=0$ If $S_{ij}=0.5$ then $S_{ji}=0.5$ If $S_{ij}=0$ then $S_{ji}=1$ Therefore $S_{ji}=1-S_{ij}$ $S_{ij}=t(t-1)/2$ The preference table for paired comparison evaluation of five samples:

TABLE 1

| | | (j) | | | | | |
|---|---|---|---|---|---|---|---|
| | | $A_1$ | $A_2$ | $A_3$ | $A_4$ | $A_5$ | Total Score |
| (i) | $A_1$ | — | $S_{12}$ | $S_{13}$ | $S_{14}$ | $S_{15}$ | $\Sigma S_{1j}$ |
| | $A_2$ | $S_{21}$ | — | $S_{23}$ | $S_{24}$ | $S_{25}$ | $\Sigma S_{2j}$ |
| | $A_3$ | $S_{31}$ | $S_{32}$ | — | $S_{34}$ | $S_{35}$ | $\Sigma S_{3j}$ |
| | $A_4$ | $S_{41}$ | $S_{42}$ | $S_{43}$ | — | $S_{45}$ | $\Sigma S_{4j}$ |
| | $A_5$ | $S_{51}$ | $S_{52}$ | $S_{53}$ | $S_{54}$ | — | $\Sigma S_{5j}$ |

EXAMPLE

A spinneret having 58 filament capillaries is arranged in a circular layout with eight rows and 6 to 9 capillaries per row. The capillaries are formed generally according to FIG. 2 with appropriate design for the desired arm angle, percent void and modification ratio and are offset with respect to the capillaries of each next adjacent row. Nylon 6 polymer is extruded with conventional spinning conditions into a quench stack, drawn, textured and taken up onto a package where it is further processed into typical carpet yarn. The carpet yarn is then tufted into a primary backing using conventional tufting methods to make samples 6, 7, 8 and d in the following tables. Samples A and C are untufted carpet yarn. The face yarn of the carpet samples exhibits excellent bulk, luster, soiling hiding, resiliency and appearance retention.

COMPARATIVE EXAMPLE

U.S. Pat. No. 4,492,731 to Bankar et al. is followed to make samples 2, 3, 4, 5, C, b and c below. Samples 1 and a are other solid trilobal cross-sections.

TABLE 2

| ID | Twist (turn/in) | MR | Arm Angle | Denier | Cover (cc/g) | Void (%) | Luster | Soiling |
|---|---|---|---|---|---|---|---|---|
| 1 | 0 | 2.6 | 21 | 16 | 4.2 | 0 | 2 | 3 |
| 2 | 0 | 3.3 | 19 | 16 | 4.6 | 0 | 4 | 4 |
| 3 | 0 | 3.6 | 14 | 16 | 4.9 | 0 | 4 | 4 |
| 4 | 0 | 2.8 | 28 | 16 | 4.6 | 0 | 2 | 3 |
| 5 | 0 | 3.5 | 20 | 16 | 4.8 | 0 | 4 | 4 |
| 6 | 0 | 2.5 | 35 | 20 | 5.2 | 6 | 1 | 1 |
| 7 | 0 | 3.1 | 11 | 20 | 6.2 | 5 | 3 | 2 |
| 8 | 0 | 5.7 | 7 | 20 | 6.7 | 5 | 4 | 3 |

TABLE 3

| ID | Twist (turn/in) | MR | Cover (cc/g) | Luster By Photometer |
|---|---|---|---|---|
| A | 1.6 | 2.6 | 4.9 | 67 |
| | 3.6 | | 4.0 | |
| C | 1.6 | 2.6 | 4.4 | 66 |
| | 3.6 | | 3.7 | |

The statistical analysis of total scores from the paired comparison test (11 observers) on the swivel chair worn (1,500 cycles) tufted carpet tiles (two-ply heatset, 3.75 tpi, 1/10 gauge tufter, 0.18 inch pile height, 26 oz. per square yard) is listed in the following Table 4.

TABLE 4

| ID | Twist (turn/in) | MR | Arm Angle | Denier | Cover (cc/g) | Void (%) | Luster | Wear Score |
|---|---|---|---|---|---|---|---|---|
| a | 3.8 | 2.5 | 21 | 19 | 4.3 | 0 | 2 | 2.45 |
| b | 3.8 | 3.0 | 14 | 19 | 5.0 | 0 | 3 | 2.59 |
| c | 3.8 | 3.1 | 21 | 19 | 5.2 | 0 | 2 | 1.64 |

TABLE 4-continued

| ID | Twist (turn/in) | MR | Arm Angle | Denier | Cover (cc/g) | Void (%) | Luster | Wear Score |
|---|---|---|---|---|---|---|---|---|
| d | 3.8 | 2.8 | 24 | 19 | 5.7 | 6 | 1 | 7.09 |

What is claimed is:

1. A trilobal synthetic thermoplastic filament having a single void extending approximately axially central, a total cross-sectional void area between about 3 and about 10 percent void, a modification ratio between about 2 and about 6, and an arm angle between about 7° and about 35°.

2. The filament of claim 1 wherein the modification ratio is between about 2 and about 3.5.

3. The filament of claim 1 wherein the arm angle is between about 10° and about 35°.

4. A carpet made from filaments according to claim 1.

* * * * *